US005137290A

United States Patent [19]

Patterson et al.

[11] Patent Number: 5,137,290

[45] Date of Patent: Aug. 11, 1992

[54] ICE SKATE BLADE ALIGNMENT MECHANISM

[75] Inventors: Patrick E. Patterson; Leon E. Girard, both of Ames, Iowa

[73] Assignee: Iowa State University Research Foundation, Inc., Ames, Iowa

[21] Appl. No.: 726,768

[22] Filed: Jul. 8, 1991

[51] Int. Cl.[5] ..... A63C 1/04

[52] U.S. Cl. ..... 280/11.12; 280/11.31; 403/4

[58] Field of Search ..... 280/11.12, 11.17, 11.18, 280/11.26, 11.27, 11.3, 11.31, 11.32; 269/904; 403/4, 11, 12

[56] References Cited

U.S. PATENT DOCUMENTS

| | | | |
|---|---|---|---|
| 660,752 | 10/1900 | Evans | 280/11.12 |
| 1,773,303 | 8/1930 | Duff | 280/11.12 |
| 1,844,025 | 2/1932 | Bachand | 280/11.12 |
| 1,991,855 | 2/1935 | Johnson | 280/11.12 |
| 2,985,461 | 5/1961 | Lynn et al. | 280/11.12 X |
| 3,243,191 | 3/1966 | Weisman | 280/11.12 |
| 3,918,729 | 11/1975 | Peters | 280/11.3 |
| 4,561,796 | 12/1985 | Hanaoka | 403/4 |
| 4,932,675 | 6/1990 | Olson et al. | 280/11.12 X |

*Primary Examiner*—Andres Kashnikow
*Assistant Examiner*—Michael Mar
*Attorney, Agent, or Firm*—Henderson & Sturm

[57] ABSTRACT

A blade alignment mechanism for an ice skate including a clamp for releasably securing the blade assembly to a skating boot in a trial position. The clamp includes a first member secured to the boot at a point remote from the screw apertures in the front or rear flanges, and a second member attached to the first member and disposed to contact one of the flanges to hold it in a trial position. The second member includes an enlarged adjustment opening that allows side-to-side and fore-and-aft adjustment of the second member with respect to the first member. The first and second members are locked into the selected trial position by tightening a threaded fastener that draws contacting serrated faces of the first and second members together. Thus, the blade assembly is releasably attached to the boot in a trial position for trial use by the skater.

12 Claims, 3 Drawing Sheets

ICE SKATE BLADE ALIGNMENT MECHANISM

TECHNICAL FIELD

This invention relates to ice skates, and more particularly to a blade alignment system for ice skates.

BACKGROUND ART

In world-class competitive ice skating, skaters insist that the blade assembly be precisely mounted on the skating boot so that the skate has the exact feel and balance demanded by the skater. Presently, the blade assembly is positioned on the boot in a trial position and secured by screws that attach through apertures in the front and rear flanges of the blade assembly.

A serious problem arises, however, when the skater is not satisfied with the initial trial position, and the blade assembly must be moved slightly. The slight position change often forms an oversized screw hole in the boot that will not firmly hold the screw that normally secures the blade assembly to the boot.

Those concerned with these and other problems recognize the need for an improved blade alignment mechanism for an ice skate.

DISCLOSURE OF THE INVENTION

The present invention provides a blade alignment mechanism for an ice skate including a clamp for releasably securing the blade assembly to a skating boot in a trial position. The clamp includes a first member secured to the boot at a point remote from the screw apertures in the front or rear flanges, and a second member attached to the first member and disposed to contact one of the flanges to hold it in a trial position. The second member includes an enlarged adjustment opening that allows side-to-side and fore-and-aft adjustment of the second member with respect to the first member. The first and second members are locked into the selected trial position by tightening a threaded fastener that draws contacting serrated faces of the first and second members together. Thus, the blade assembly is releasably attached to the boot in a trial position for trial use by the skater.

An object of the present invention is the provision of an improved blade alignment mechanism for an ice skate.

Another object is to provide a blade alignment mechanism that allows rapid adjustment from one trial position to another.

A further object of the invention is the provision of a blade alignment mechanism that is durable and easy to maintain.

Still another object is to provide a blade alignment mechanism that may be removed after the blade assembly is satisfactorily positioned and permanently secured to the skating boot.

A still further object of the present invention is the provision of a blade alignment mechanism that may be used in lieu of the conventional method of permanently securing the blade assembly to the skating boot.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
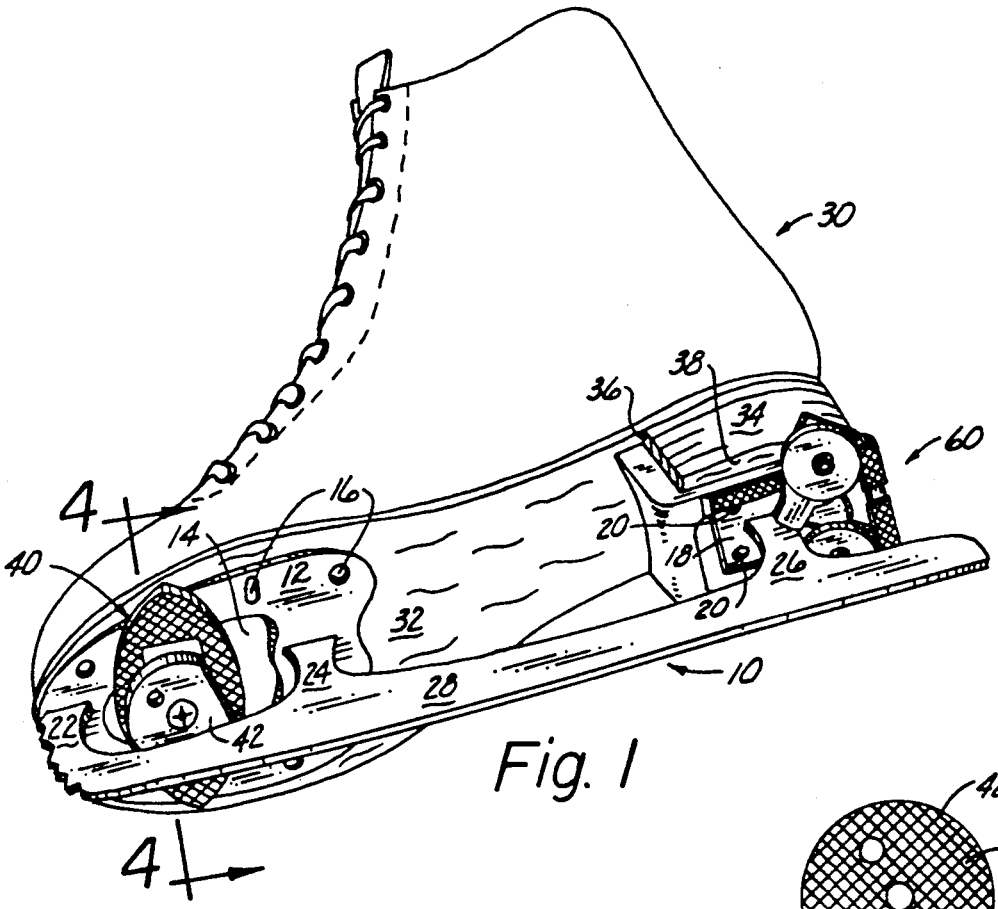
FIG. 1 is a perspective view showing two embodiments of the blade alignment clamp of the present invention: one embodiment releasably securing the front flange of the blade assembly to the sole portion of the skating boot; and another embodiment releasably securing the rear flange of the blade assembly to the heel portion of the skating boot.
Figure 5:
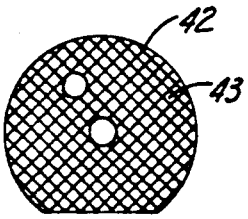
FIG. 5 is a top plan view taken along line 5—5 of FIG. 2 showing the serrated face of the first member of the front flange clamp.
Figure 2:
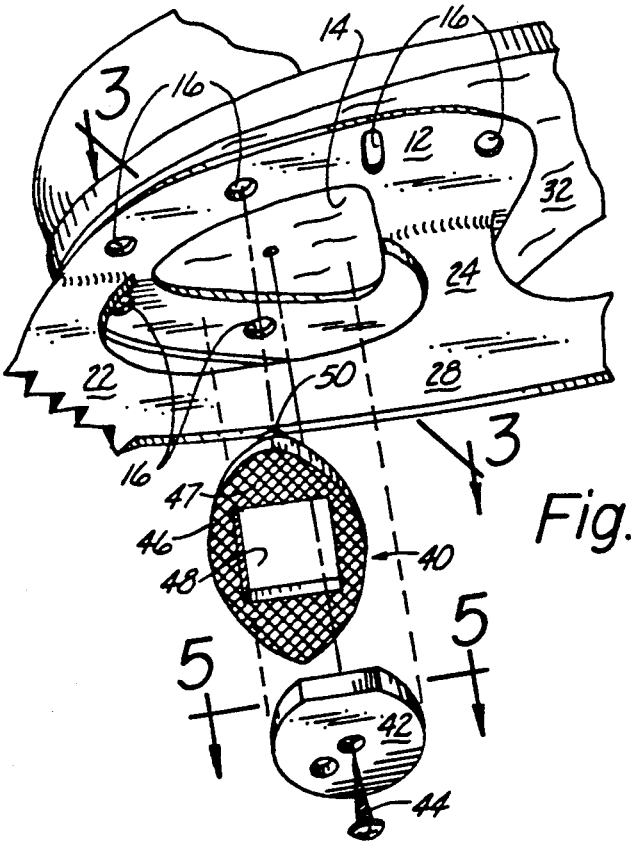
FIG. 2 is a partial exploded perspective view showing the orientation of the components of the front flange clamp.
Figure 3:
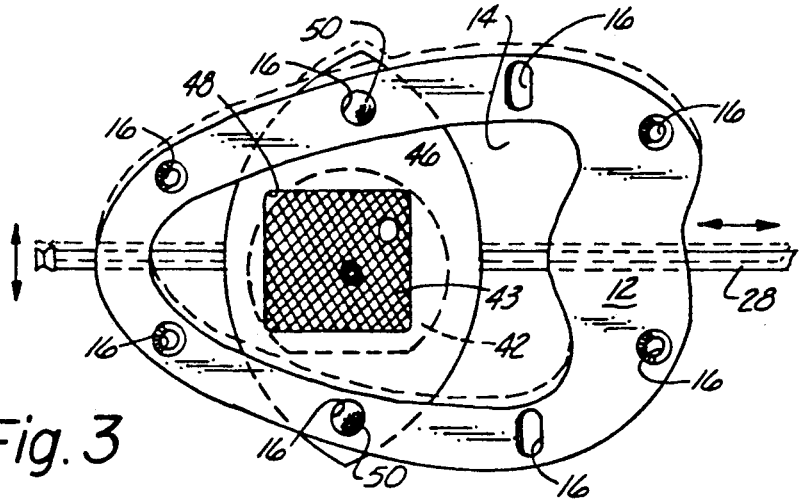
FIG. 3 is a top plan view taken along line 3—3 of FIG. 2 illustrating the side-to-side adjustment of the front flange in dashed line.

Referring now to the drawings, wherein like reference numerals designate identical or corresponding parts throughout the several views, FIG. 1 shows two embodiments of the blade alignment clamp of the present invention releasably securing a blade assembly (10) to a skating boot (30). The blade assembly (10) includes a front flange (12) having an enlarged central opening (14) and a plurality of screw apertures (16), and a rear flange (18) having a plurality of screw apertures (20). Vertical posts (22, 24, 26) interconnect the front and rear flanges (12, 18) and a runner (28). The skating boot (30) has a sole portion (32) and a heel portion (34). The heel (34) includes a vertical front edge (36) and a horizontal lower surface (38). One embodiment of the blade alignment clamp, the front flange clamp (40), releasably secures the front flange (13) to the sole (32). Another embodiment, the rear flange clamp (60), releasably secures the rear flange (18) to the heel (34).

Figure 4:
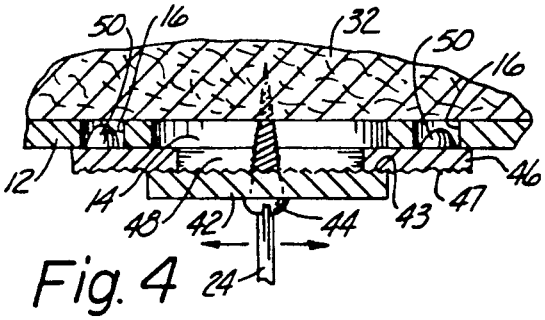
FIG. 4 is a front elevation sectional view taken along line 4—4 of FIG. 1, the directional arrow indicating the side-to-side adjustment of the front flange.
Figure 6:
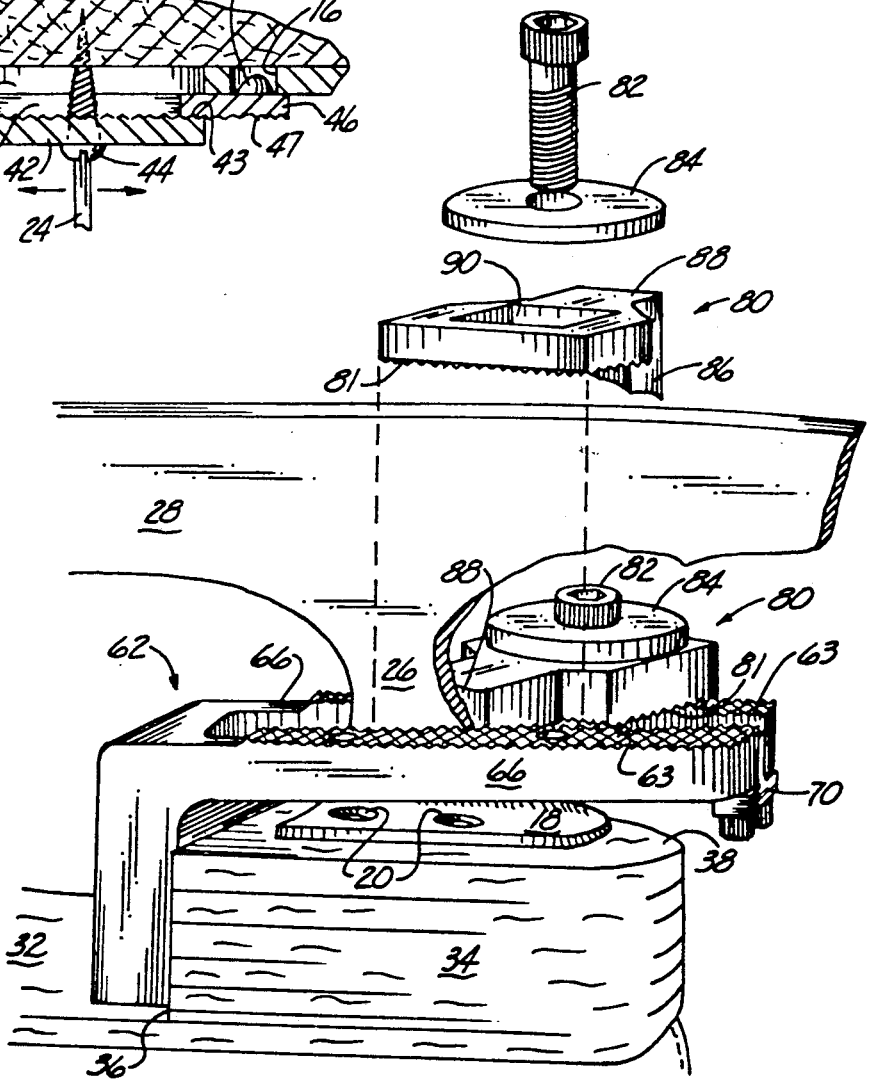
FIG. 6 is a partial exploded perspective view showing the orientation of the components of the rear flange clamp.
Figure 7:
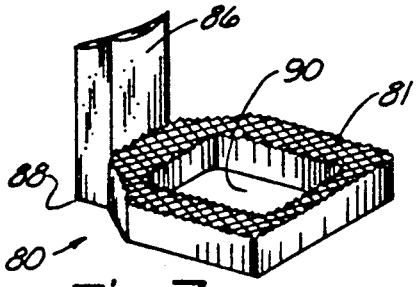
FIG. 7 is a perspective view showing the serrated face of the second member of the rear flange clamp.
Figure 8:
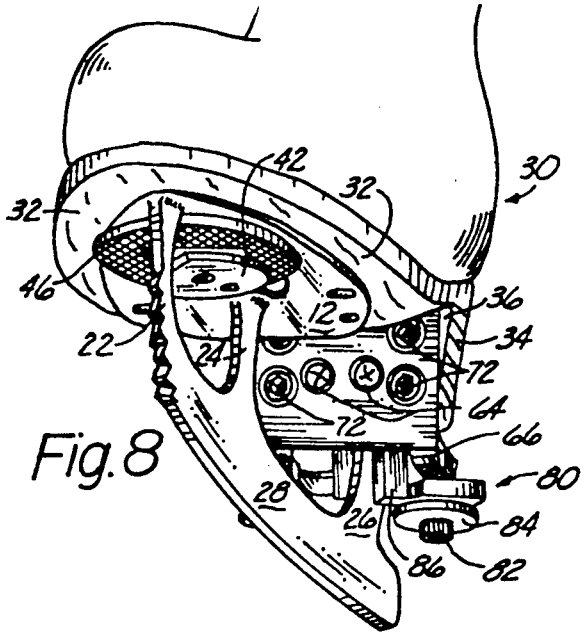
FIG. 8 is a perspective view similar to FIG. 1, but showing the leveling screws which form a part of the first member of the rear flange clamp.
Figure 9:
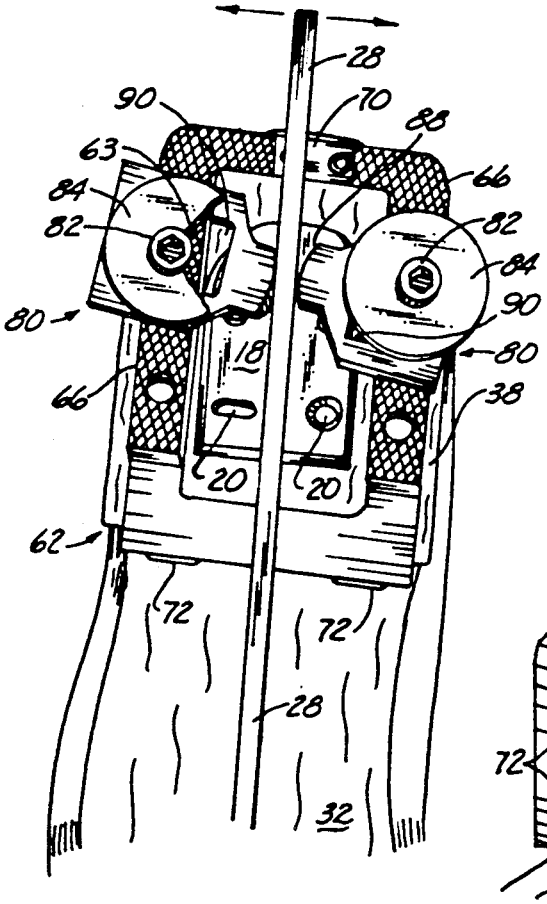
FIG. 9 is a bottom plan view of the rear flange clamp.
Figure 10:
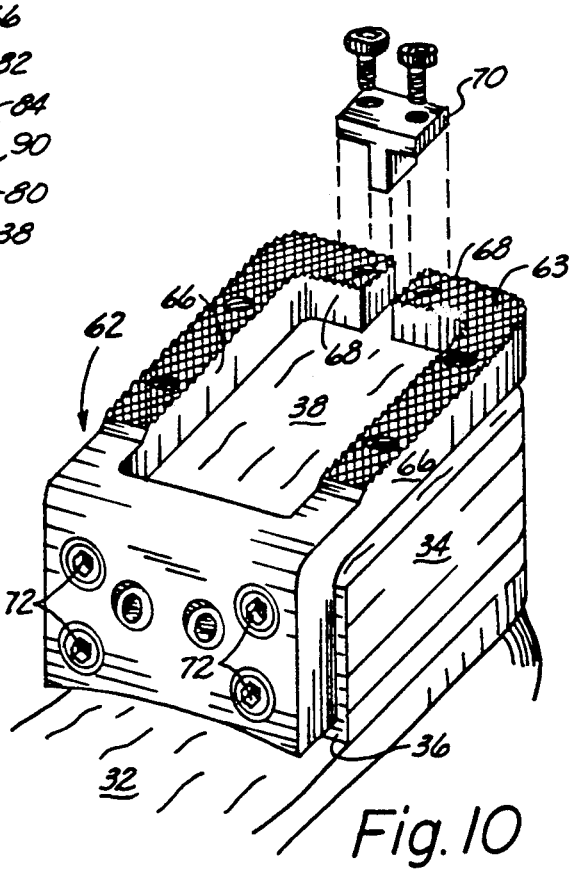
FIG. 10 is an exploded perspective view illustrating the position of the removable bridge that forms a part of the first member of the rear flange clamp.

As most clearly shown in FIGS. 2–5, the front flange clamp (40) includes a first member (42) attached by a screw (44) to the sole (32), and a second member (46) disposed between the first member (42) and the front flange (12). The second member (46) has an enlarged adjustment opening (48) and a pair of projections (50) disposed to be received in laterally opposed screw apertures (16). As best shown in FIG. 4, the contacting faces (43, 47) of the first and second members (42, 46) are serrated in a diamond pattern to provide a positive lock when the screw (44) is tightened.

In use, the front flange (12) is initially aligned with the sole (32) in an approximate position and the projections (50) of the second member are inserted into laterally opposed apertures (16). The first member (42) is then positioned over and around the adjustment opening (48) in the second member (46), and the screw (44) is extended through the adjustment opening (48), the central opening (14), and is threaded into the sole (12) and tightened. As the screw (44) is tightened, the first and second members (42, 46) are drawn together and the serrations on their contacting faces (43, 47) mesh together and lock the first member (46) in position with respect to the second member (42). The skater then uses the skate to determine if the blade assembly is properly positioned to give the desired feel and balance. If the first trial position is not satisfactory, the screw (44) is loosened slightly to allow side-to-side and fore-and-aft repositioning of the second member (46) with respect to the first member (42). The screw (44) is then retightened to lock the blade assembly (10) in a second trial position. The blade assembly (10) can thus be repositioned indefinitely without making further screw holes in the sole (32). Once the skater is satisfied with the feel and balance, screws (not shown) are inserted into the sole through all available apertures (16) in the front flange (12). The front flange clamp (40) is then removed by removing the screw (44), and additional screws (not shown) are secured through the laterally opposed apertures (16) after the second member (46) is removed.

FIGS. 6-10 best show the embodiment of the blade alignment clamp suitable to releasably attach the rear flange (18) to the heel (34). The rear flange clamp (60) includes a first member (62) attached by screws (64) to the front edge (36) of the heel (34), and a pair of second members (80) attached to the first member (62) and disposed to contact the rear flange (18) to hold it in a trial position.

The first member (62) is generally L-shaped and includes a pair of rearwardly directed arms (66) spaced below and disposed parallel to the lower surface (38) of the heel (34). The arms (66) are positioned laterally on opposite sides of post (26) and the ends (68) are closed by a removable bridge (70). The bridge (70) is provided to stabilize the first member (62), while allowing it to be removed after the rear flange (18) is permanently affixed to the heel (34). Leveling screws (72) are provided to selectively contact the front edge (36) of the heel (34) to properly align the first member (62) so that the ar. (66) are maintained substantially parallel to the lower surface (38) of the heel (34).

A second member (80) is attached to each of the arms (66) by a threaded fastener (82) and an enlarged washer (84). Each second member (80) includes a downwardly extending finger (86) disposed to contact a part of the rear flange (18), and an extension (88) that is disposed to extend toward and contact one side of the post (26). An enlarged adjustment opening (90) is formed through the second member (80).

In use, the rear flange (18) is initially aligned with the heel (34) and the first member (62) is loosely attached to the front edge (36) by screws (64). The leveling screws (72) are then adjusted to position the first member (62) so that the arms (66) are essentially parallel to the top surface (38) of the heel (34), and the screws (64) are then tightened. A second member (80) is then positioned on each of the arms (66) so that the finger (86) contacts a part of the rear flange (18) and the extension (88) abuts the post (26). The threaded fasteners are then tightened to draw the first and second members (62, 80) together causing the serrated faces (63, 81) to mesh and lock. The skater then tests the skate for feel and balance. If additional trial positions are required, the fasteners (82) are simply loosened, the rear flange (18) together with the pair of second members (80) are repositioned, and the fasteners (82) are retightened. Once the skater is satisfied with the position of the blade assembly (10), screws (not shown) are inserted through apertures (20) into the heel (34) to permanently secure the blade assembly (10). The bridge (70) is then removed, the screws (64) are removed, and the rear flange clamp (62) is removed.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

We claim:

1. In a blade alignment mechanism for an ice skate including a skating boot having a sole portion and a heel portion, and a blade assembly having a front flange adapted to mount to the sole portion with fasteners received through front flange apertures, a rear flange adapted to mount to the heel portion with fasteners received through rear flange apertures, and posts attached to and interconnecting the front and rear flanges and a runner fixedly attached to said front and rear flanges, the improvement comprising:

first clamp means for releasably securing the front flange to a front sole portion in a trial position, the clamp means including:

a first member releasably secured to the front sole portion at a point remote from the flange apertures;

a second member releasably attached to the first member and releasably attached to the front flange to hold the front flange in the trial position;

means for adjusting the side-to-side and fore-and-aft position of the second member, with the front flange attached thereto, with respect to the first member; and means for locking the position of the second member with respect to the first member, thereby locking the blade assembly in the trial position for trial use by a skater before permanently securing the blade assembly to the sole portion with fasteners attached through the front and rear flange apertures.

2. The alignment mechanism of claim 1 wherein the front flange has an enlarged central opening, and wherein the first member is secured to the sole, portion by a fastener that extends through the central opening, and wherein the second member is disposed between the first member and the front flange.

3. The alignment mechanism of claim 2 wherein the adjustment means includes an enlarged adjustment opening formed through the second member and disposed in registry with the central opening of the front flange.

4. The alignment mechanism of claim 3 wherein the second member includes a pair of projections disposed to be received into a pair of laterally opposed front flange apertures, whereby movement of the second member with respect to the front flange is restricted.

5. The alignment mechanism of claim 2 wherein the locking means includes a threaded fastener disposed to secure the first member to the sole portion, whereby tightening of the threaded fastener draws the first member into close frictional contact with the second member.

6. The alignment mechanism of claim 5 wherein contacting faces of the first member and the second member are serrated.

7. The alignment mechanism of claim 1 further including clamp means second releasably securing the rear flange to the heel portion of the boot in the trial position.

8. The alignment mechanism of claim 7 wherein the second clamp means includes a first member secured to the heel portion by fasteners extending into a front edge of the heel, the first member including a pair of rearwardly directed arms spaced below and disposed substantially parallel to a lower surface of the heel and spaced laterally on opposite sides of the post that interconnects the rear flange and the runner, and wherein a second member is attached to each of the arms, each second member including an upwardly extending finger disposed in contacting relationship with the rear flange.

9. The alignment mechanism of claim 8 wherein the second member is attached to each arm by a threaded fastener and an enlarged washer, and wherein the adjustment means includes an enlarged adjustment opening formed through the second member, the threaded fastener being disposed to extend through the adjustment opening.

10. The alignment mechanism of claim 9 wherein each second member includes an extension disposed to extend toward and contact one side of the post that interconnects the rear flange and the runner at a point spaced below the lower surface of the heel, whereby lateral twisting of the blade assembly is restricted.

11. The alignment mechanism of claim 8 wherein the locking means is the threaded fastener and the enlarged washer, whereby tightening of the threaded fastener draws the second member into close frictional contact with the first member.

12. The alignment mechanism of claim 11 wherein contacting faces of the first member and the second member are serrated.

* * * * *